US011026508B1

(12) United States Patent
Lehoe et al.

(10) Patent No.: US 11,026,508 B1
(45) Date of Patent: Jun. 8, 2021

(54) CUSTOMIZABLE DESK ORGANIZER

(71) Applicant: Equiper, LLC, Bradenton, FL (US)

(72) Inventors: Kevin Lehoe, Royal Oak, MI (US); Meredith Hiltbrand Lehoe, Royal Oak, MI (US)

(73) Assignee: Equiper, LLC, Bradenton, FL (US)

( * ) Notice: Subject to any disclaimer, the term of this patent is extended or adjusted under 35 U.S.C. 154(b) by 0 days.

(21) Appl. No.: 16/946,560

(22) Filed: Jun. 26, 2020

Related U.S. Application Data

(60) Provisional application No. 62/896,960, filed on Sep. 6, 2019.

(51) Int. Cl.

| | |
|---|---|
| ***A45C 11/34*** | (2006.01) |
| ***A47B 47/00*** | (2006.01) |
| ***B43K 23/00*** | (2006.01) |
| ***B65D 25/06*** | (2006.01) |
| ***B43M 99/00*** | (2010.01) |

(52) U.S. Cl.
CPC ..... *A47B 47/0091* (2013.01); *B43K 23/001* (2013.01); *B43M 99/008* (2013.01); *B65D 25/06* (2013.01); *A47B 2200/0084* (2013.01); *B65D 2313/04* (2013.01)

(58) Field of Classification Search
CPC ..... A47B 63/00; A47B 47/0091; A47B 2200/0084; B42F 7/10; B43K 23/001; B43M 99/008; B65D 25/06; B65D 2313/04; G09F 7/04
USPC ..... 211/10, 11, DIG. 10
See application file for complete search history.

(56) References Cited

U.S. PATENT DOCUMENTS

| | | | | |
|---|---|---|---|---|
| 2,583,097 | A * | 1/1952 | Heimann | A47B 19/06 248/456 |
| 4,163,497 | A * | 8/1979 | McEwen | B42F 17/12 211/11 |
| 5,607,135 | A * | 3/1997 | Yamada | A47B 23/043 248/447 |
| 5,755,321 | A * | 5/1998 | Wang | B43M 99/008 206/214 |
| D651,213 | S * | 12/2011 | Magness | D14/447 |
| 10,125,915 | B1 * | 11/2018 | Phifer | F16M 11/041 |
| 10,420,419 | B2 * | 9/2019 | Kasravi | B42F 7/145 |

(Continued)

OTHER PUBLICATIONS

Ugmonk. Gather Basic Set (Walnut). Downloaded on Sep. 2, 2020. https://ugmonk.com/collections/gather/products/gather-basic-set-walnut?variant=19421959782457.

*Primary Examiner* — Matthew W Ing
(74) *Attorney, Agent, or Firm* — Smith & Hopen, P.A.; Steven M. Forte; Paul Murty

(57) ABSTRACT

A customizable, reliable, and secure desktop organizer is provided having a base, a first receptacle, and a second receptacle. Each of the receptacles includes a set of sockets that are configured to receive one or more magnets. The magnets of the receptacles are equidistantly spaced apart from one another at the same distance as the magnets disposed within the base. Thus, when the receptacles are brought into proximity with the base, the magnets of the receptacles and the base are magnetically attracted to one another, securing the receptacles to the base. Because the magnets of the base are spaced apart at the same distance as the magnets of the receptacles, when coupled to one another, the receptacles are automatically aligned into proper position with respect to the base.

17 Claims, 8 Drawing Sheets

(56) References Cited

U.S. PATENT DOCUMENTS

| | | | | |
|---|---|---|---|---|
| 2006/0244348 | A1* | 11/2006 | Richied | B42F 7/14 312/108 |
| 2007/0044360 | A1* | 3/2007 | Hillis | G09F 7/04 40/621 |
| 2018/0226002 | A1* | 8/2018 | Sandow | G09F 7/04 |
| 2019/0313788 | A1* | 10/2019 | Sheldon | F16B 5/07 |

* cited by examiner

CUSTOMIZABLE DESK ORGANIZER

CROSS-SECTION TO RELATED APPLICATIONS

This nonprovisional application is a continuation of and claims priority to provisional application No. 62/896,960, entitled "CUSTOMIZABLE DESK ORGANIZER," filed Sep. 6, 2019 by the same inventor.

BACKGROUND OF THE INVENTION

1. Field of the Invention

This invention relates, generally, to desktop organizers. More specifically, it relates to modular desktop organizers.

2. Brief Description of the Prior Art

Hundreds of millions of people around the world spend a substantial portion of their day sitting behind a desk, table, or even standing behind a workbench performing various tasks. For example, a person in a typical office environment would be required to use and interact with several office supplies, some of which are small and easily lost, such as binder and paper clips. These office supplies are easily misplaced, increasing the frustration and inefficiency of the work being performed and associated costs. Further, as time passes, the once clean and organized desk gets bombarded with clutter with no practical or efficient way to organize the clutter.

It is desirable for workers and users of desks, tables, benches, and the like to be able to work as efficiently and smoothly as possible. This means that the supplies needed to perform any given task should be organized and accessible so that the supplies are ready to be used at a moment's notice. In response to this need, various companies have developed a wide range of organizers, which have unsuccessfully attempted to solve this problem.

Previous attempts, such as the UGMONK GATHER, include an elongated base having a plurality of grooves disposed within the base. Pegs located in the bottom of and extending outward from a container are designed to be received within the grooves cut into the base. However, this design has a number of drawbacks in which, first and foremost, is the slidable grid system. While the sliding grid system allows for some limited customizability, it also provides for a less stable and productive product. Small movement or shifts when removing and placing items within the containers can easily cause the containers to shift and slide out of an alignment set by the user-thus requiring constant readjustment. Further, if the organizational system were to be accidentally knocked over, the pegs of each of the containers would fall out of the grooves, requiring a user to reposition each of the individual containers along with the misplaced office supplies.

Further, the pegs protruding from the bottom of the containers can break easily. Because the pegs protrude and do not sit flush with the container, the likelihood that one or more of the pegs would be damaged is increased. If such breakage were to occur, the entire container would be rendered non-functional for its intended purpose. Additionally, repeated removal and placement of the container, or even the routine pressure and stress associated with the normal use of the container, subjects the pegs to increased stress, which can weaken the pegs and eventually cause the pegs to break.

Accordingly, what is needed is a modular desktop organizer that allows for secure and reliable attachment of receptacles onto a base. However, in view of the art considered as a whole at the time the present invention was made, it was not obvious to those of ordinary skill in the field of this invention how the shortcomings of the prior art could be overcome.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

BRIEF SUMMARY OF THE INVENTION

The long-standing but heretofore unfulfilled need for a modular desk organizer that allows customization of receptacles when securely attached to a base is now met by a new, useful, and nonobvious invention.

The novel structure includes a modular desktop organizer that comprises a base having a top surface configured to support a plurality of receptacles. A plurality of magnets is disposed within the base and reside within a first plane. Each of the magnets of the plurality of magnets is equidistantly spaced apart and positioned proximal to the top surface.

A first receptacle having a first shape and a first set of sockets disposed within the first receptacle residing within a second plane is provided to interact with a base magnetically. At least two complementary magnets, ferromagnetic, or paramagnetic materials, are disposed within the first set of sockets respectfully. When the first receptacle is brought into proximity of the base, at least two of the plurality of magnets of the base are magnetically coupled to the at least two complementary magnets of the first receptacle, thereby securing the first receptacle to the base. The distance between the at least two complementary magnets of the first receptacle is equal to the distance between two magnets within the base, such that when the first receptacle is magnetically coupled to the base, the horizontal and lateral movements of the first receptacle with respect to the base is restricted.

A second receptacle having a first shape that is different than a second shape and the second set of sockets disposed within the second receptacle residing within a third plane. In an embodiment, the second receptacle may be the same size and shape as the first receptacle. At least two complementary magnets are disposed within the second set of sockets, such that when the second receptacle is brought into proximity of the base, at least two of the plurality of magnets of the base are magnetically coupled to the at least two complementary magnets of the second receptacle, thereby securing the second receptacle to the base. The distance between the at least two complementary magnets of the second receptacle is equal to the distance between two magnets within the base, such that when the second receptacle is magnetically coupled to the base, the horizontal and lateral movements of the second receptacle with respect to the base is restricted.

In an embodiment, the alignment of the at least two complementary magnets of each of the first and the second receptacles when positioned over the plurality of magnets of the base allows for the biasing of each of the first and the second receptacle into a correct position with respect to the base.

In yet another embodiment, the second receptacle further includes a first portion residing parallel to the first plane when the second receptacle is secured to the base. A second portion extends away from the first portion toward a terminal end. A third portion extends away from each of the first and the second portions. Angle α is formed by the intersection of the first portion and the second portion, while angle β is formed between the third portion and the first portion. A retention mechanism is disposed at the terminal end of the third portion and is configured to prevent an object disposed on a ledge formed by the third portion, the second portion, and the retention mechanism from unintentionally being disposed away from the second receptacle.

The location of the first and the second receptacle is interchangeable when the first and the second receptacles are coupled to the base allowing for various configurations of the modular desktop organizer.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

Referring to FIGS. 1-8, the modular desktop organizer 5 (hereinafter "organizer") comprises base 10 and receptacle 12. Base 10 and receptacle 12 may be made from any material that a person of ordinary skill in the art would use to provide structural support, rigidity, and reliability including, but not limited to: acrylonitrile-butadiene-styrene (ABS), epoxy resins, rubber, latex, polyvinylchloride (PVC), vinyl chloride, thermoplastics, ceramic, glass, granite, marble, metal, metal alloys, textiles, or other suitable materials. In an embodiment, base 10 and receptacle 12 may each be monolithically formed and/or manufactured through injection molding, 3D printing, metal casting, carving, or other suitable manufacturing methods known in the art.

Figure 1:
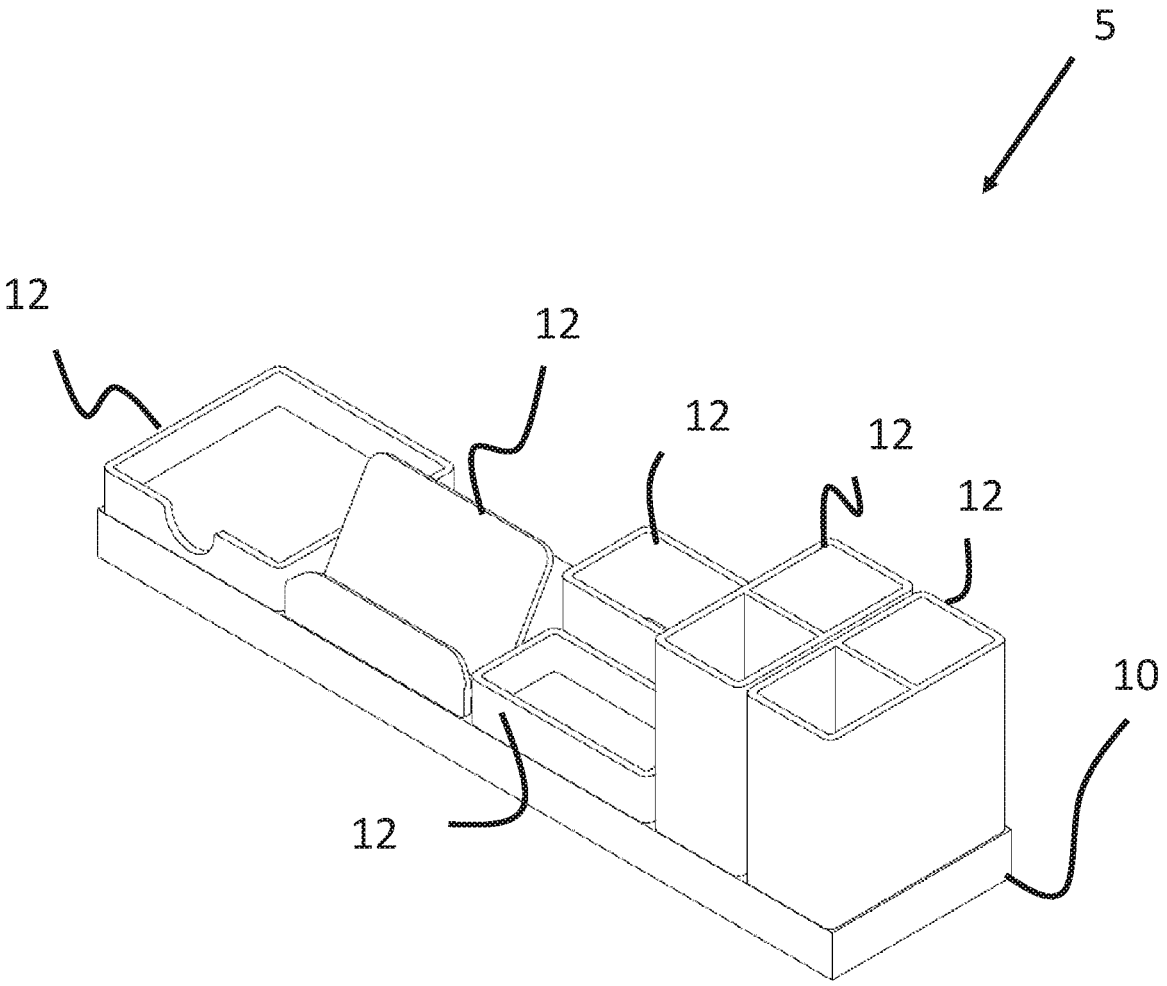
FIG. 1 is a perspective view of an embodiment of the desk organizer depicting a plurality of receptacles coupled to a base.
Figure 2:
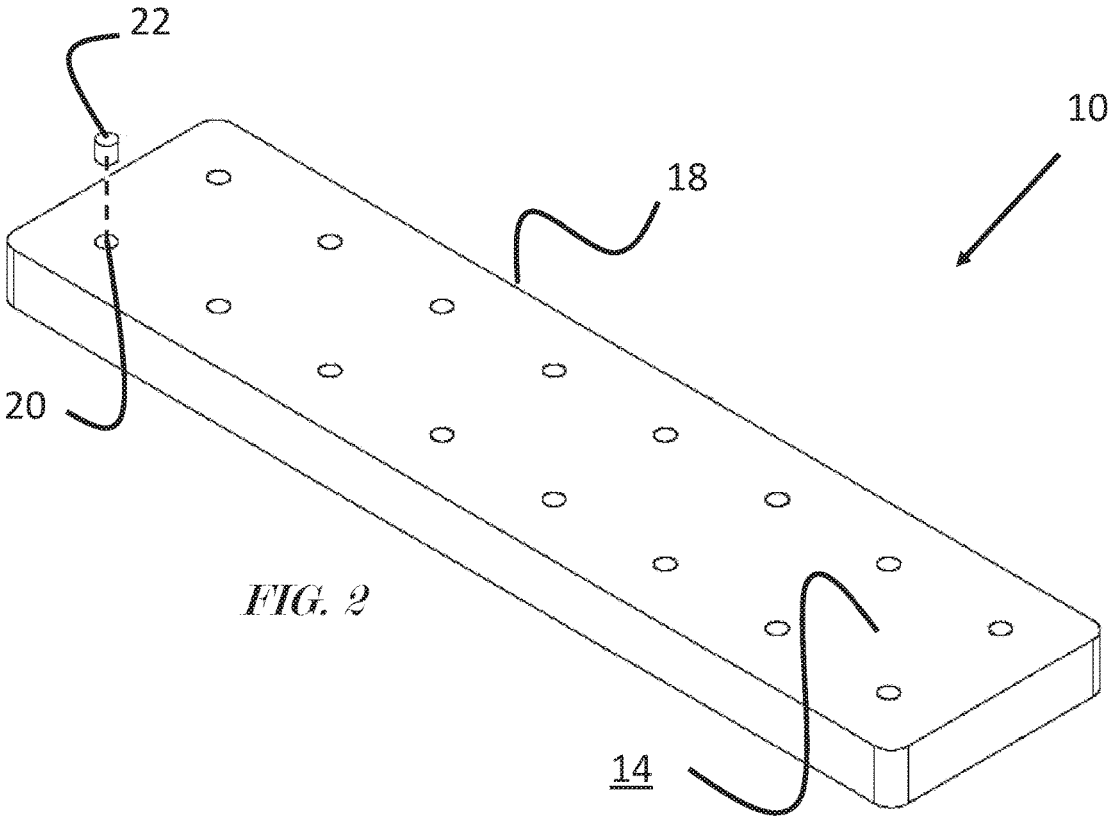
FIG. 2 is a perspective view of the base.
Figure 3:
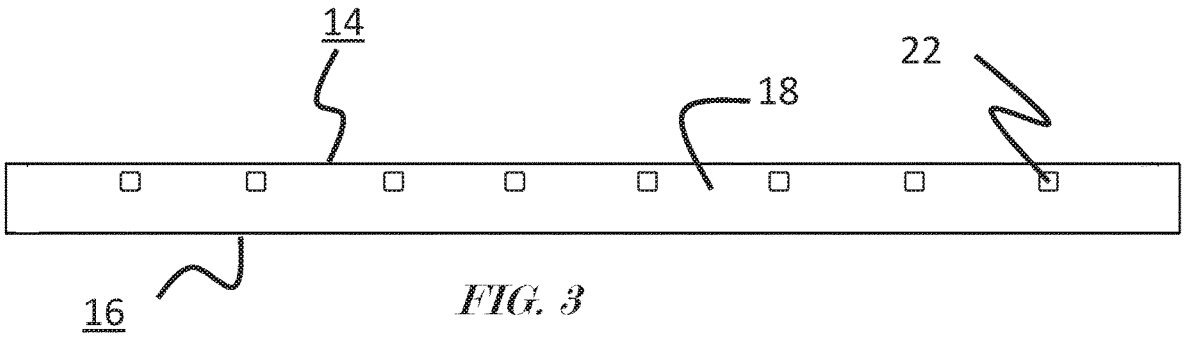
FIG. 3 is a side view of the base showing the magnets disposed within the body and positioned proximal to the top surface.
Figure 4:
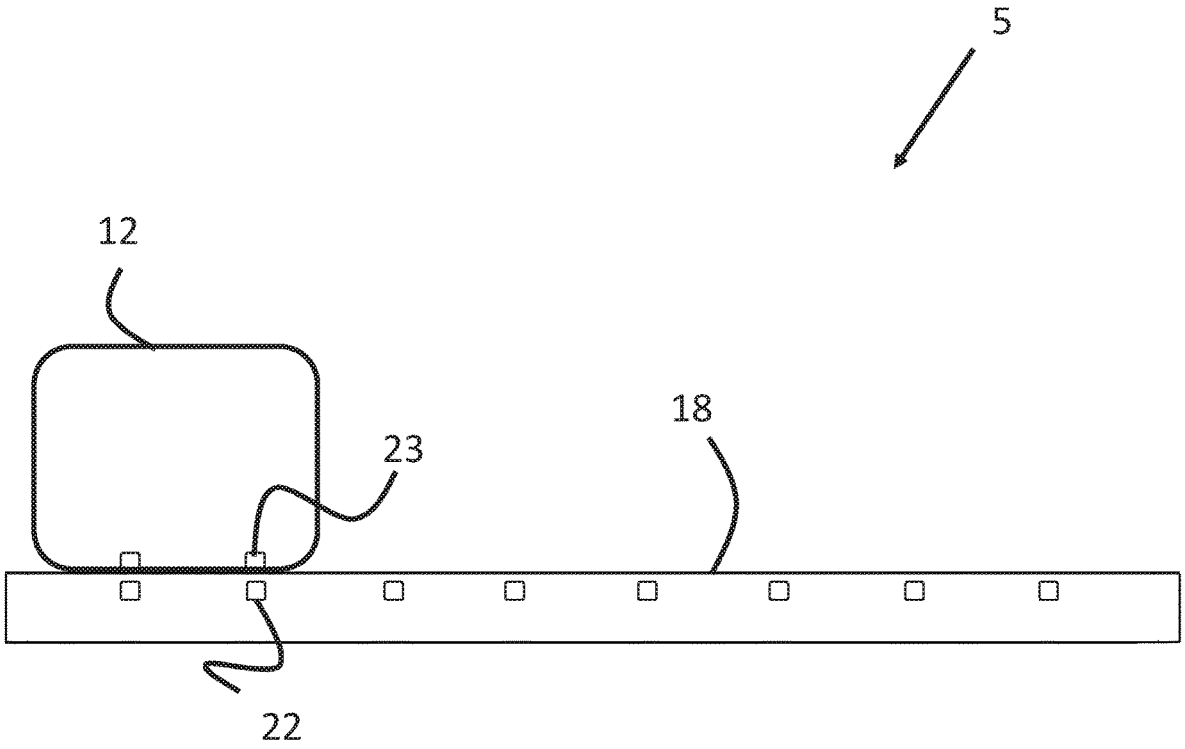
FIG. 4 depicts a side view of the modular desktop organizer depicting a receptacle coupled to the base.

As depicted in FIGS. 2-4, base 10 has a substantially elongated shape having a flat top surface 14 and a flat bottom surface 16 with base body 18 extending therebetween. Base 20 may have other geometrical shapes where top surface 14 and bottom surface 16 may be formed in the shape of squares, triangles, ovals, polygons, or other geometrical shapes. Top surface 14 defines a plurality of base sockets 20, adjacent base sockets 20 are equidistantly spaced apart from one another. Each base socket 20 is sized to receive and retain base magnet 22. Preferably, base magnets 22 sit flush with top surface 14, however, in an embodiment, each base magnet 22 may be positioned proximal to top surface 14 and may be disposed within base body 18, such that base magnets 22 are concealed within base body 18 and are not accessible and/or visible through top surface 14.

Figure 5:
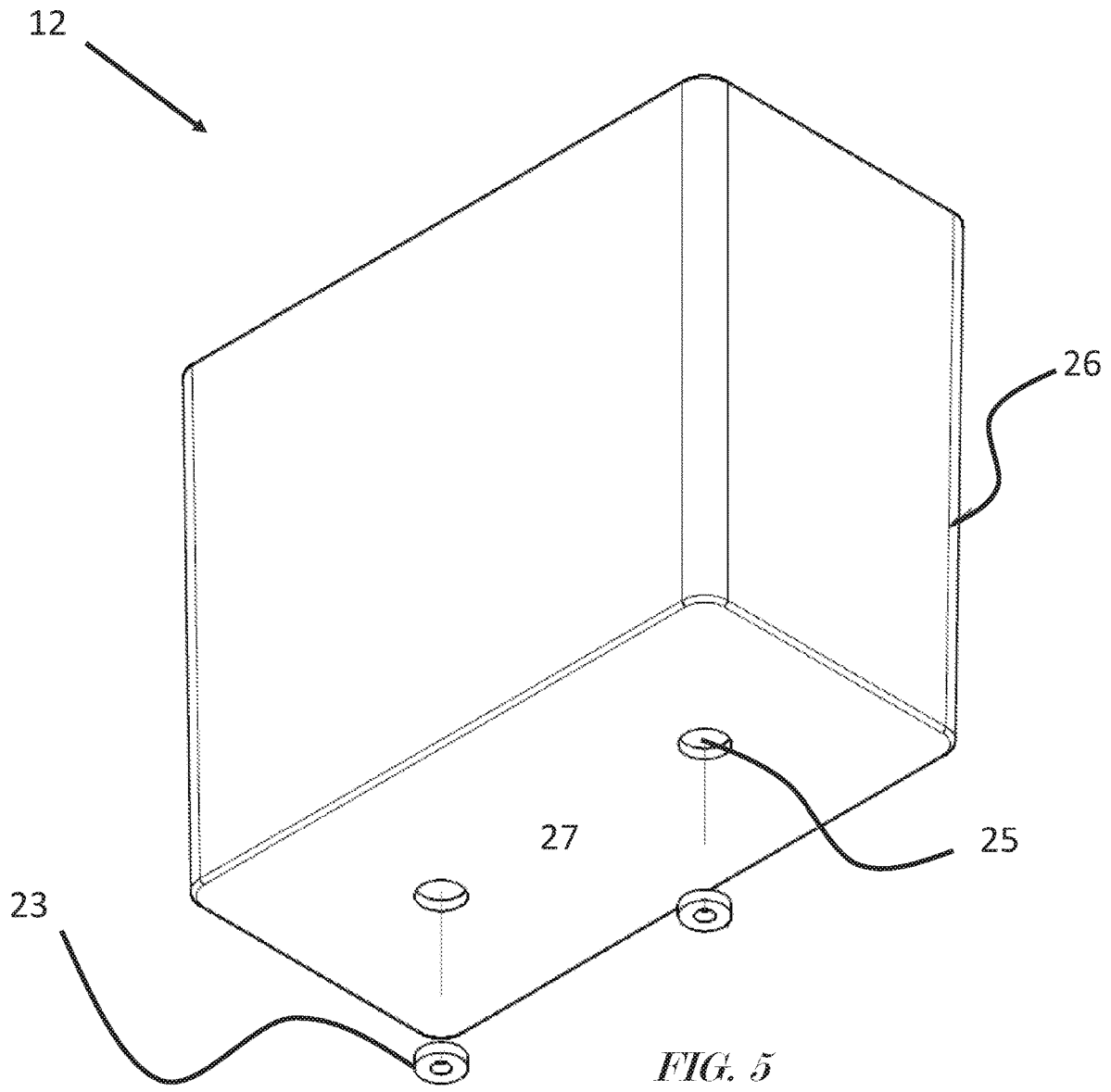
FIG. 5 is an exploded perspective view of an embodiment of a receptacle.
Figure 6:
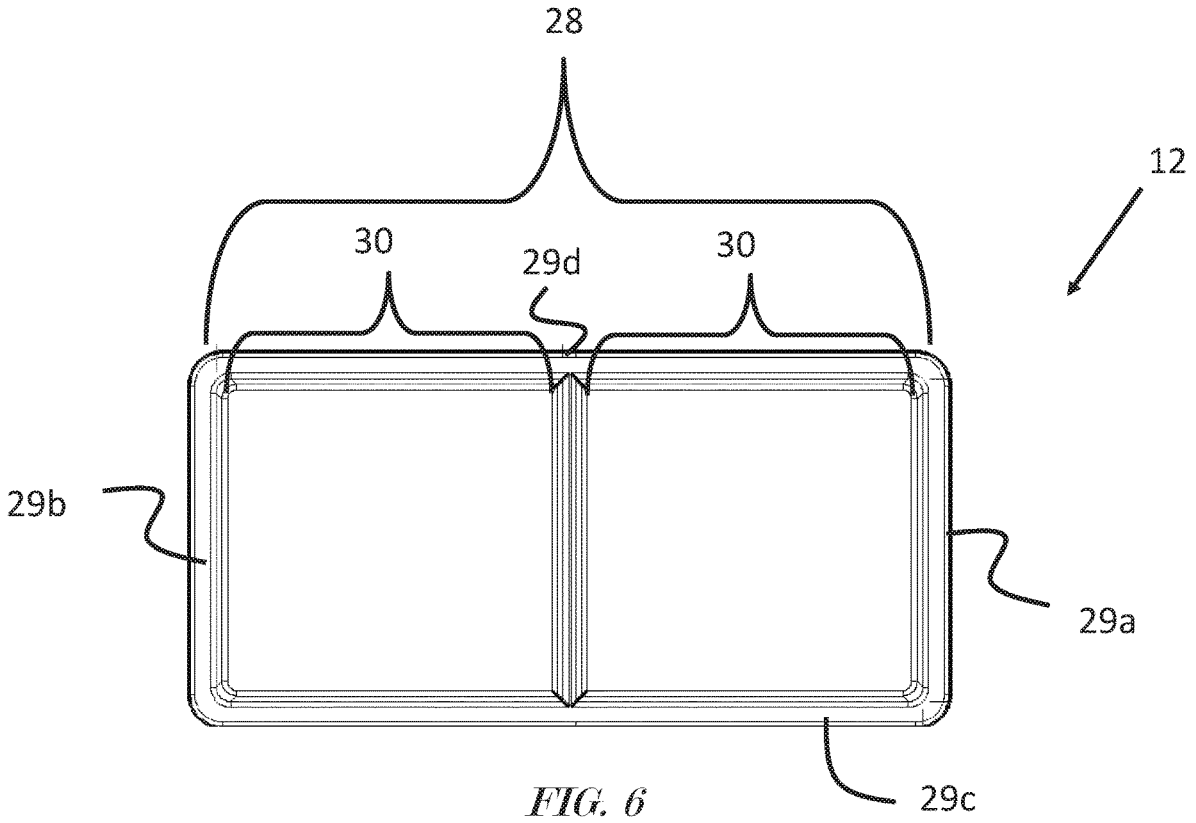
FIG. 6 is a top view of an embodiment of the receptacle shown in FIG. 5.
Figure 7:
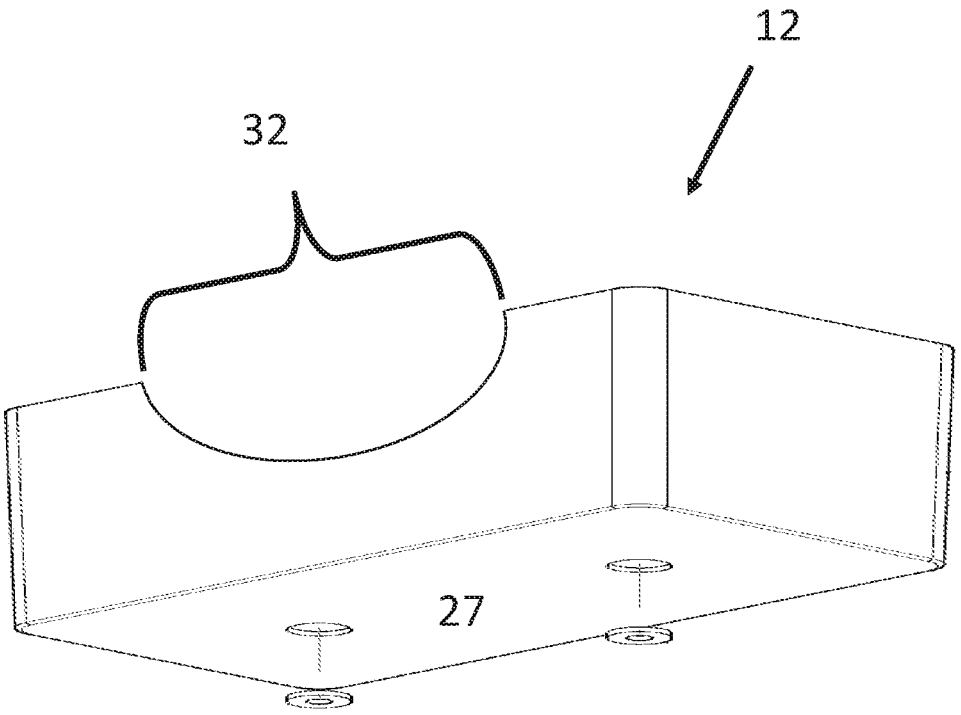
FIG. 7 is a perspective view of an embodiment of a receptacle having a cutout portion.

One or more receptacles 12 are configured to magnetically couple to base 10. In an embodiment, as shown in FIGS. 5-7, receptacle 12 may be secured to base 10 using fasteners, magnets, screws, nails, clips, adhesive, or other suitable material or structure that is configured to secure receptacle 12 to base 10.

As depicted in FIGS. 5-9, receptacle 12 includes receptacle body 26 configured retain objects within cavity 28, or objects may reside on ledge 29. In an embodiment, cavity 28 may include partitions 30 to provide further organization. Partitions 30 may extend the entire length of body 26 with cavity 28 or may partially extend therein. For example, in an office setting, receptacle 12 may be configured to hold note pads, cell phone, paper clips, binder clips, paper, pencil, pens, or any other supplies routinely used in an office setting. In a workbench setting, such as a home garage, receptacle 12 may be configured to hold nuts, bolts, screws, washers, nails, screwdrivers, rachets, batteries, or any other objects typically found in a workbench setting. When organizer 5 includes two or more receptacles 12 positioned on the same body 10, a user increases the number and variety of objects that organizer 5 is configured to hold.

Receptacle body 26 includes one or more receptacle sockets 25 disposed within bottom portion 27 of receptacle body 26. Each receptacle socket 25 is configured to receive receptacle magnet 23. In an embodiment, receptacle magnet 23 and/or base magnet 22 may be formed of neodymium iron boron, samarium cobalt, alnico, ferrite, steel, stainless steel, iron, or any other object known in the art to produce or be attracted to a magnetic field. In an embodiment, receptacle magnet 23 or base magnet 22 may be any mineral, element, or material that is at least partially formed from at least one ferromagnetic or paramagnetic material and has magnetic properties. In an embodiment, receptacle magnet 23 and/or base magnet 22 has a gauss value between 50 and 1500 gauss, such that receptacle 12 is not easily knocked off base 10 when it is magnetically secured thereto, while not being so strong that a human would be unable to decouple receptacle 12 from base 10.

Receptacle magnet 23 may protrude from bottom portion 27 of receptacle body 26 or may sit flush. In embodiments including two or more receptacle sockets 25, the adjacent receptacle magnets 23 are equidistantly spaced apart from one another and positioned in the same or substantially the same configuration and spacing as base magnets 22 of base 10, thereby allowing for magnetic coupling when receptacle magnets 23 of receptacle 12 are brought into proximity with base magnets 22 of base 10. In an embodiment, receptacle body 26 includes two sets of lateral walls 29 in an orthogonal relationship with one another. The first set includes first receptacle wall 29*a* opposite second receptacle wall 29*b*, and the second set includes third receptacle wall 29*c* opposite fourth receptacle wall 29*d*.

The complementary spacing and configuration of base magnets 22 of base 10 and receptacle magnets 23 of receptacle 24 facilitate proper alignment of receptacle 12 with respect to base 10. When receptacle magnets 23 of receptacle 12 are magnetically coupled with base magnets 22 of base 10, the magnetic forces urge the receptacle 12 into proper alignment with base 10. In an embodiment, base magnets 22 of base 10 and receptacle magnets 23 of receptacle 12 may be secured within their respective sockets 20, 25 by press-fitting, adhesive, or other methods known in the art to secure base magnets 22 within base sockets 20 and receptacle magnets 23 within receptacle sockets 25.

In an embodiment, receptacles 12 may be arranged in several configurations by replacing, swapping, and/or removing receptacles 12 from base 10, and then recoupling receptacles 12 to base 10 in a different configuration. These new configurations may be based on user preferences and needs at the time. In an embodiment, base 10 may be coupled to a single receptacle 12 or base 10 may be coupled to a plurality of receptacles 12. As depicted in FIG. 7, an embodiment of receptacle 12 is shown having cutout 32 designed to provide easy access to an object residing within receptacle 12. Cut out 32 allows for ease of removal by providing access to a portion of the object within receptacle 12 by the user, thereby facilitating the removal of the object.

Figure 8:
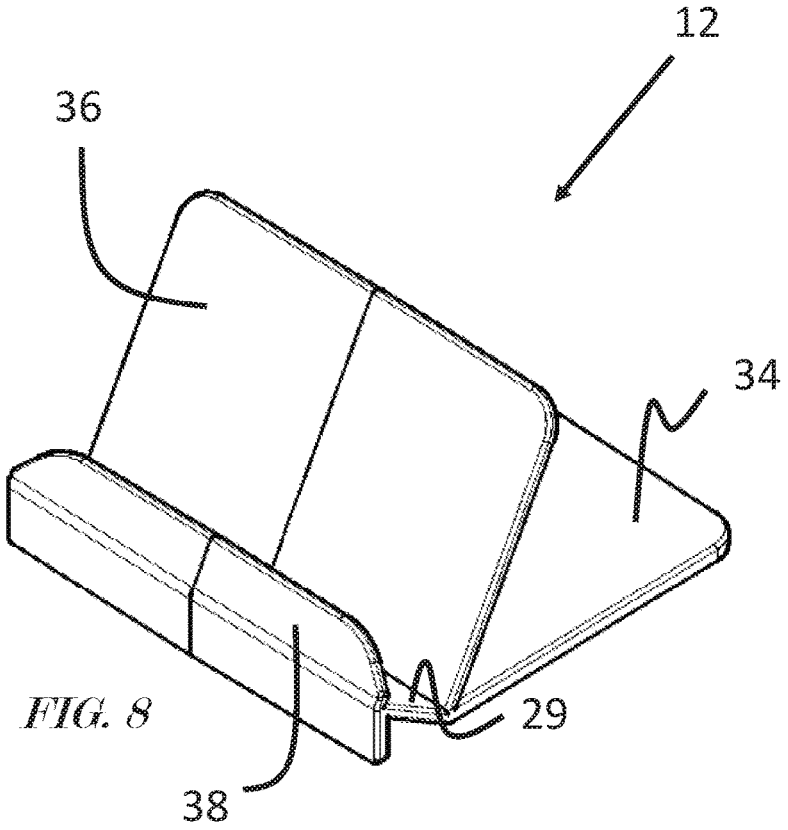
FIG. 8 is a perspective view of an embodiment of an easel shaped receptacle.
Figure 9:
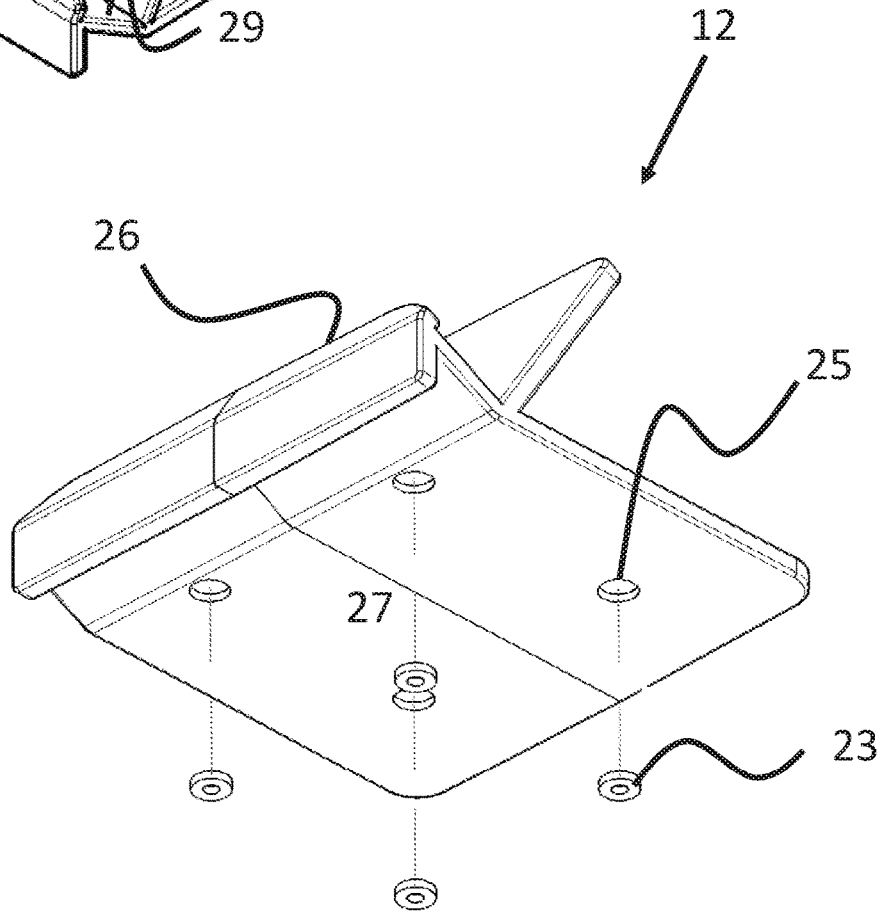
FIG. 9 is an exploded perspective view of an embodiment of the ease shaped receptacle depicted in FIG. 8.
Figure 10:
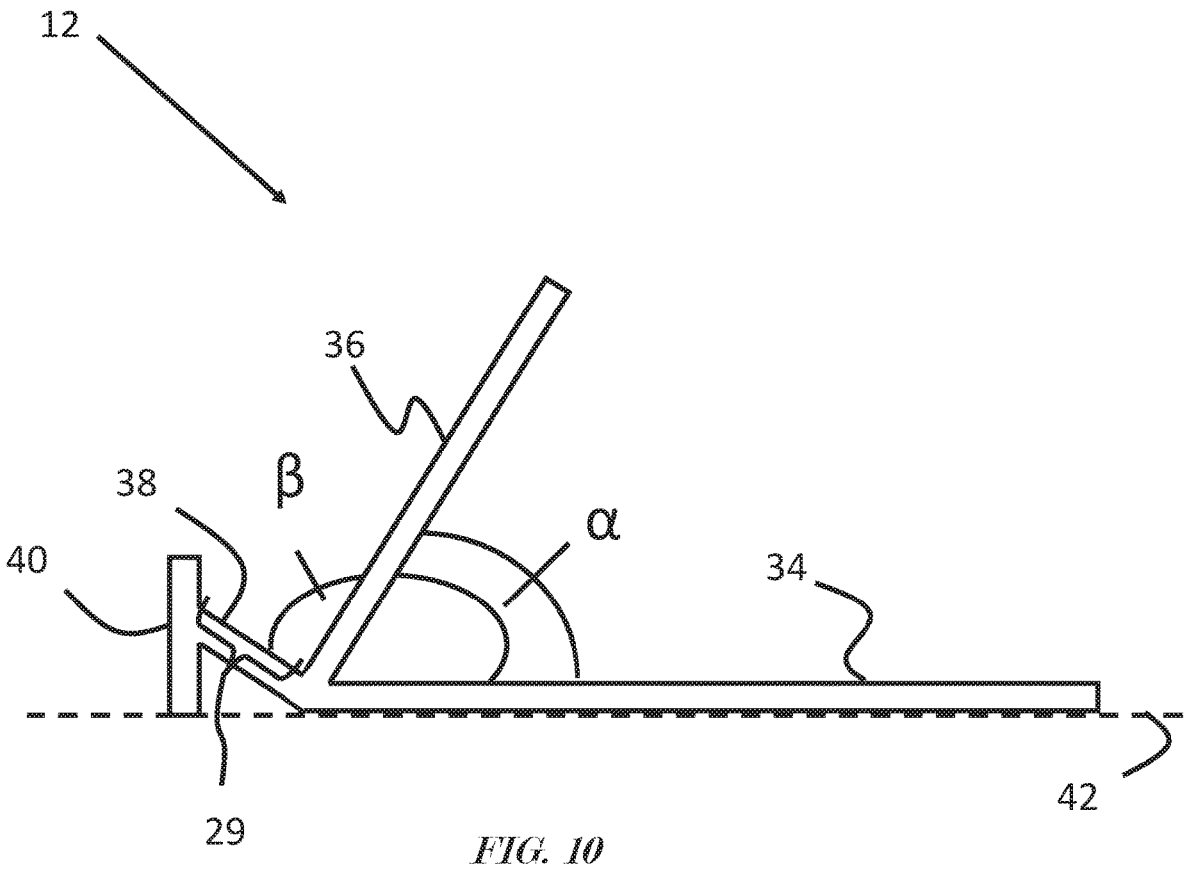
FIG. 10 is a side view of an embodiment of an easel shaped receptacle.

An embodiment of receptacle 12 is depicted in FIGS. 8-10. In such an embodiment receptacle 12 is configured to receive a cell phone, book, paper, or the like using support channel 29, such as an easel-type element, slot, or ledge. Receptacle 12 is formed, having first portion 34 residing within plane 42, while second 36 portion and third 38 portion are bent out of plane 42 at corresponding angles $\alpha$ and $\beta$, respectively. As shown in FIG. 10, angle $\alpha$ is less than angle $\beta$ and formed between first portion 34 and second portion 36. Angle $\beta$ is greater than angle $\alpha$ and formed between first portion 34 and third portion 38. When receptacle 12 is positioned adjacent to top surface 16 of base 10, first portion 34 is parallel with top surface 16 of base 10. Second portion 36 is configured to provide support to object residing within support channel 29 and extends away from the first portion 34 at a predetermined distance. Third portion 38 extends away from both first portion 34 and second portion 36 and forms the bottom portion of ledge 29 for receiving an object. Disposed at the terminal end of third portion 38 is retention mechanism 40. Retention mechanism 40 at least partially extends the entire distance of the terminal end of the third portion 38 and is configured to prevent the object from sliding out of channel 29 and off of third portion 38.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A modular desktop organizer comprising:

a base having a top surface;

a first set of magnets disposed within the base, each magnet of the first set of magnets residing within a. first plane, wherein two magnets within the first set of magnets are separated from one another by a first predefined distance and positioned proximal to the top surface of the base;

a first receptacle having a first bottom surface having a first geometric shape configured to mate with the top surface of the base, the first receptacle comprising:

a first portion residing parallel to the first plane when the first receptacle is positioned adjacent to the base, a second portion extending away from a portion of the first portion toward a terminal end of the second portion, wherein a first angle is formed between the first portion and the second portion, a third portion extending away from the first portion and the second portion toward a terminal end of the third portion, wherein a second angle is formed between the first portion and the third portion, wherein the first angle is less than the second angle, and a retention mechanism disposed at the terminal end of the third portion, the retention mechanism configured to prevent an object disposed on a ledge formed at least partially by the third portion, the second portion, and the retention mechanism from unintentionally being disposed away from the first receptacle;

a plurality of sockets disposed within the first receptacle, wherein two sockets of the plurality of sockets are separated from one another by a second predefined distance, the second predefined distance being substantially equal to the first predefined distance; and a second set of magnets disposed within the first receptacle and positioned within a second plane, wherein each magnet of the second set of magnets resides within one of the plurality of sockets, such that when the first bottom surface of the first receptacle is placed onto the top surface of the base, at least two magnets of the first set of magnets of the base are magnetically coupled to at least two magnets of the second set of magnets of the first receptacle, thereby securing the first receptacle to the base, whereby the second plane is parallel to the first plane when the first receptacle is magnetically secured to the base.

2. The modular desktop organizer of claim 1 further comprising:

a second receptacle having a second bottom surface, the second bottom surface having a second geometric shape, wherein the second geometric shape has a different geometric configuration than the first geometric shape of the first receptacle;

a second set of sockets disposed within the second receptacle and residing within a third plane; and a third set of magnets disposed within the second set of sockets, such that when the second bottom surface of the second receptacle is placed onto the top surface of the base, at least two magnets of the first set of magnets of the base are magnetically coupled to at least two magnets of the third set of magnets of the second receptacle, thereby securing the second receptacle to the base, whereby the third plane is parallel to the first plane;

wherein placement of the first and the second receptacles with respect to the base is interchangeable, thereby enabling multiple configurations of the modular desktop organizer.

3. The modular desktop organizer of claim 2, wherein each of the at least two magnets of the base is secured within each of the first and second set of sockets with an adhesive.

4. The modular desktop organizer of claim 2, wherein the alignment of the at least two magnets of each of the first and the second receptacles when positioned over the first set of magnets of the base, allows for the biasing of each of the first and the second receptacle into the correct position with respect to the base.

5. The modular desktop organizer of claim 2, wherein the second receptacle further includes a cavity configured to receive an object.

6. The modular desktop organizer of claim 2, wherein the second receptacle further includes one or more partitions that provide for additional organization.

7. The modular desktop organizer of claim 2, further comprising:

a third receptacle having a third bottom surface configured to mate with the top surface of the base, the third bottom surface of the third receptacle base having a third shape;

a first and a second set of lateral walls in an orthogonal relationship with one another, wherein the first set of lateral walls includes a first receptacle wall opposite a second receptacle wall and the second set of lateral walls includes a third receptacle wall opposite a fourth receptacle wall, wherein each of the first and the second sets of lateral walls extend from a portion of the third receptacle base; and a cutout formed within at least one of the receptacle walls, wherein the cutout is configured to aid in the removal of an object disposed within the third receptacle.

8. The modular desktop organizer of claim 1, wherein each of the first, second, and third portion are monolithically formed.

9. The modular desktop organizer of claim 1, wherein each magnet of the first set of magnets and the second set of magnets has a gauss value between 50 G and 1,500 G.

10. A customizable desk organizer for the organization of supplies comprising:

a base having a top surface;

a first set of magnets disposed within the base, each magnet of the plurality of magnets residing within a first plane, wherein two magnets within the first set of magnets are separated from one another by a first predefined distance and positioned proximal to the top surface;

a first receptacle having a first bottom surface configured to mate with the top surface of the base, the first bottom surface having a first shape;

a plurality of sockets disposed within the first receptacle, wherein two sockets of the plurality of sockets are separated from one another by a second predefined. distance, the second predefined distance being substantially equal to the first predefined distance;

a first cavity disposed within the first receptacle and configured to receive an object, and a second set of magnets disposed within the first receptacle and positioned within a second plane, wherein each magnet of the second set of magnets resides within one of the plurality of sockets and secured by an adhesive, such that when the bottom surface of the first receptacle is placed onto the top surface of the base, at least two magnets of the first set of magnets of the base are magnetically coupled to at least two magnets of the second set of magnets of the first receptacle, thereby securing the first receptacle to the base, whereby the second plane is parallel to the first plane when the first receptacle is magnetically secured to the base;

a second receptacle having a second bottom surface having a second shape, the second receptacle including:

a first portion residing parallel to the first plane when the second receptacle is positioned adjacent to the base, a second portion extending away from a portion of the first portion toward a terminal end of the second portion, wherein a first angle is formed between the first portion and the second portion, a third portion extending away from the first portion and the second portion toward a terminal end of the third portion, wherein a second angle is formed between the first portion and the third portion, wherein the first angle is less than the second angle, and a retention mechanism disposed at the terminal end of the third portion, the retention mechanism configured to prevent an object disposed on a ledge formed by the third portion, the second portion, and the retention mechanism from unintentionally being disposed away from the second receptacle; and a second set of sockets disposed within the second receptacle and residing within a third plane and a third set of magnets being disposed within the second set of sockets and secured with an adhesive, such that when the second bottom surface of the second receptacle is placed onto the top surface of the base, at least two magnets of the first set of magnets of the base are magnetically coupled to at least two magnets of the third set of magnets of the second receptacle, thereby securing the second receptacle to the base, whereby the third plane is parallel to the first plane;

wherein the placement of the at least two magnets of the second set of magnets of the first receptacle and of the at least two magnets of the third set of magnets of the second receptacle with respect to the base is interchangeable, thereby enabling multiple configurations of the modular desktop organizer.

11. The customizable desk organizer for the organization of supplies of claim 10, wherein the first cavity of the first receptacle includes one or more partitions that provide for additional organization.

12. The customizable desk organizer for the organization of supplies of claim 10, wherein the first shape of the first bottom surface is a different geometric shape than the second shape of the second bottom surface.

13. The customizable desk organizer for the organization of supplies of claim 10, wherein each of the first, the second, and the third portions are monolithically formed.

14. The customizable desk organizer for the organization of supplies of claim 10 further comprising:

a third receptacle having a third bottom surface configured to mate with the top surface of the base, the third bottom surface of the third receptacle base having a third shape;

a first and a second set of lateral walls in an orthogonal relationship with one another, wherein the first set of lateral walls includes a first receptacle wall opposite a second receptacle wall and the second set of lateral walls includes a third receptacle wall opposite a fourth receptacle wall, wherein each of the first and the second sets of lateral walls extend from a portion of the third receptacle base; and a cutout formed within at least one of the receptacle walls, wherein the cutout is configured to aid in the removal of an object disposed within the third receptacle.

15. The modular desktop organizer of claim 10, wherein each magnet of the first set of magnets is encapsulated within the base, such that each magnet of the first set of magnets is concealed from view.

16. A modular desktop organizer comprising:

a base having a top surface;

a first set of magnets disposed within the base, each magnet of the first set of magnets residing within a first plane, wherein two magnets within the first set of magnets are separated from one another by a first predefined distance and positioned proximal to the top surface;

a first receptacle having a first bottom surface configured to mate with the top surface of the base, the bottom surface having a first shape;

a plurality of sockets disposed within the first receptacle, wherein two sockets of the plurality of sockets are separated from one another by a second predefined distance, the second predefined distance being substantially equal to the first predefined distance;

a first cavity disposed within the first receptacle and configured to receive an object, wherein the first cavity includes one or more partitions; and a second set of magnets disposed within the first receptacle and positioned within a second plane, wherein each magnet of the second set of magnets resides within one of the plurality of sockets and is secured by an adhesive, such that when the first bottom surface of the first receptacle is placed onto the top surface of the base, at least two magnets of the first set of magnets of the base are magnetically coupled to at least two magnets of the second set of magnets of the first receptacle, thereby securing the first receptacle to the base, whereby the second plane is parallel to the first plane when the first receptacle is magnetically secured to the base;

a second receptacle configured to receive an object, the second receptacle including:

a first portion residing parallel to the first plane when the second receptacle is positioned adjacent to the base, a second portion extending away from a portion of the first portion toward a terminal end of the second portion, wherein a first angle is formed between the first portion and the second portion, a third portion extending away from the first portion and the second portion toward a terminal end of the third portion, wherein a second angle is formed between the first portion and the third portion, wherein the first angle is less than the second angle, a retention mechanism disposed at the terminal end of the third portion, the retention mechanism configured to prevent an object disposed on a ledge formed by the third portion, the second portion, and the retention mechanism from unintentionally being disposed away from the second receptacle, and a second bottom surface having a different geometric shape than the shape of the first bottom surface of the first receptacle;

a second set of sockets disposed within the second receptacle and residing within a third plane; and a third set of magnets disposed within the second set of sockets and secured with an adhesive, such that when the second bottom surface of the second receptacle is placed onto the top surface of the base, at least two magnets of the first set of magnets of the base are magnetically coupled to at least two magnets of the third set of magnets of the second receptacle, thereby securing the second receptacle to the base, whereby the third plane is parallel to the first plane;

wherein placement of the at least two magnets of the second set of magnets of the first receptacle and of the at least two magnets of the third set of magnets of the second receptacle with respect to the base is interchangeable, thereby enabling multiple configurations of the modular desktop organizer.

17. The customizable desk organizer for the organization of supplies of claim 16, wherein each of the first, second, and third portions are monolithically formed.

* * * * *